US007306570B1

(12) United States Patent
Julian

(10) Patent No.: US 7,306,570 B1
(45) Date of Patent: Dec. 11, 2007

(54) MULTIFUNCTION MASSAGE SYSTEM AND METHOD OF USE

(76) Inventor: Michael K. Julian, 8199 U.S. 19 North, Pinellas Park, FL (US) 33782

( * ) Notice: Subject to any disclaimer, the term of this patent is extended or adjusted under 35 U.S.C. 154(b) by 584 days.

(21) Appl. No.: 10/799,806

(22) Filed: Mar. 13, 2004

Related U.S. Application Data

(60) Provisional application No. 60/454,712, filed on Mar. 14, 2003.

(51) Int. Cl.
*A61H 7/00* (2006.01)
*A61H 19/00* (2006.01)

(52) U.S. Cl. ..... 601/87; 601/84; 601/134

(58) Field of Classification Search ..... 601/84, 601/86, 87, 89, 90, 93–95, 114, 115, 134
See application file for complete search history.

(56) References Cited

U.S. PATENT DOCUMENTS 1,572,794 A * 2/1926 Hamilton ..... 606/240
2,837,145 A * 6/1958 Goetz ..... 5/652
4,574,786 A * 3/1986 Hashimoto et al. ..... 601/99
5,020,174 A * 6/1991 Sarkozi ..... 5/640
5,183,034 A * 2/1993 Yamasaki et al. ..... 601/70
5,772,614 A * 6/1998 Lindquist ..... 601/116
6,056,707 A * 5/2000 Hayashi ..... 601/99
6,290,661 B1 * 9/2001 Cutler et al. ..... 601/49
D471,372 S * 3/2003 Inada et al. ..... D6/367
6,921,372 B2 * 7/2005 Shin ..... 601/134
2003/0009117 A1 * 1/2003 Zou ..... 601/134
2003/0199796 A1 * 10/2003 Yamazaki et al. ..... 601/87
2003/0225351 A1 * 12/2003 Wu ..... 601/99
2004/0106882 A1 * 6/2004 Tseng ..... 601/86

FOREIGN PATENT DOCUMENTS

JP 2001293056 A * 10/2001

* cited by examiner

*Primary Examiner*—Justine R. Yu
*Assistant Examiner*—Kristen C. Matter
(74) *Attorney, Agent, or Firm*—Ted Masters

(57) ABSTRACT

A multifunction massage system may be used to massage the neck and/or the back of a user. The system is placed between the user and the back of a chair with the user leaning back against the system to obtain a massage. The system includes a pair of counter rotating neck massage heads the position of which can be adjusted to suit the height of the user. The system also includes at least one pair of counter rotating back massage heads which massage the back of the user. The speed and direction of rotation of the neck and back massage heads may be selectively changed. Additionally the neck and back massage heads may be selectively caused to vibrate in one of a plurality of vibrational modes and with a high or low force.

1 Claim, 8 Drawing Sheets

Fig. 9
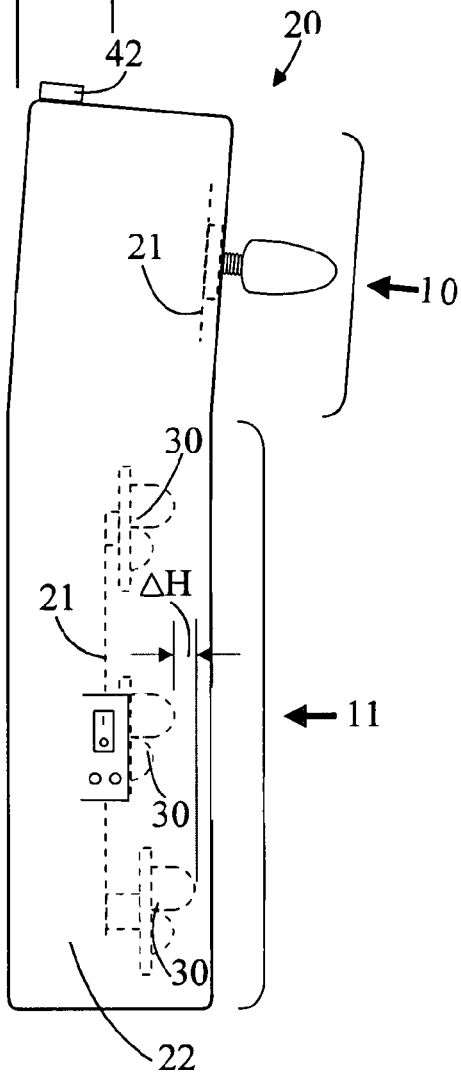
Fig. 10
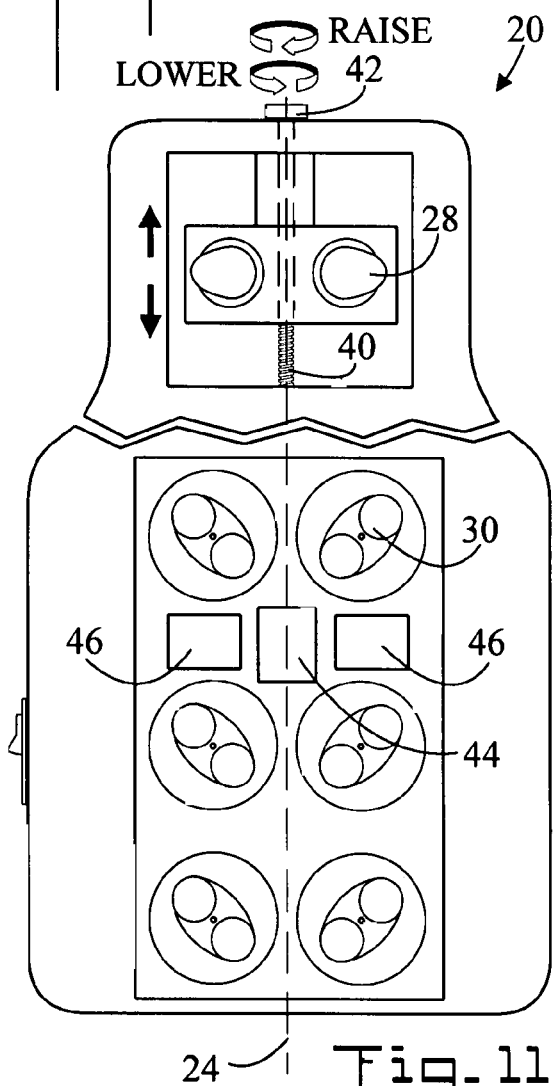
Fig. 11

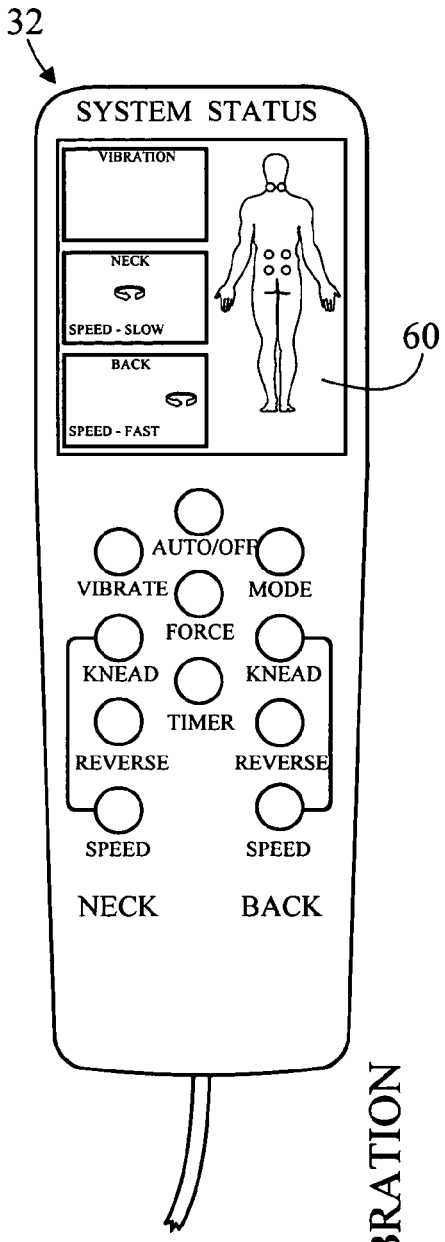
Fig. 21
Fig. 22
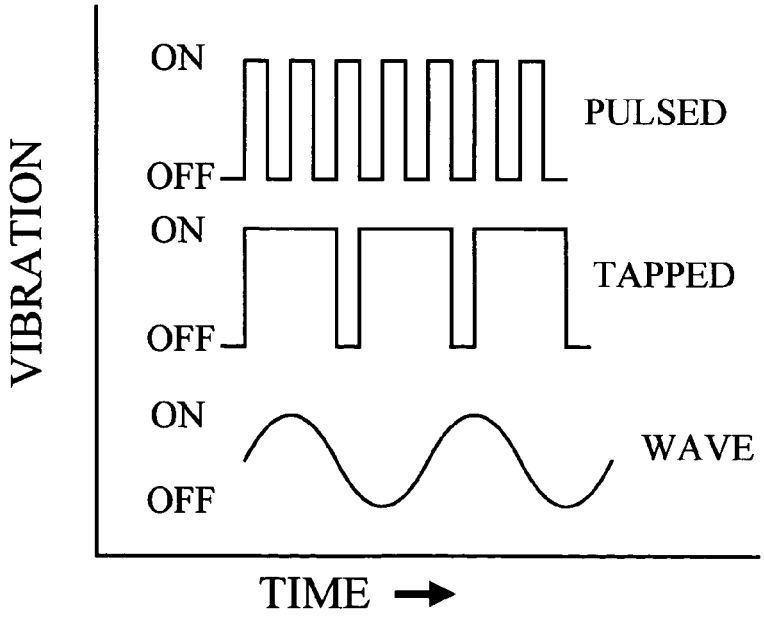

MULTIFUNCTION MASSAGE SYSTEM AND METHOD OF USE

CROSS REFERENCE TO RELATED APPLICATION

This application claims the filing benefit under 35 U.S.C. §119(e) of U.S. Provisional Application No. 60/454,712, filed Mar. 14, 2003, which is included herein by reference.

TECHNICAL FIELD

The present invention pertains generally to body massage, and more particularly to a portable massage system which is placed between a user and the back of a chair, and which massages both the neck and the back of the user.

BACKGROUND OF THE INVENTION

Massage is a well know therapy for aching muscles. In ancient times, as well as the present, the art of massage is best performed by skilled experts who are knowledgeable in techniques of relieving muscle pain. Alternatively, massage systems and machines have been developed which emulate the actions of a masseuse, and which may be used in the privacy of one's home. The present invention discloses an improved massage system which enjoys several advantages over previous devices.

SUMMARY OF THE INVENTION

The present invention is directed to a multifunction portable massage system which is used to massage (knead) the back and neck of a user either independently or at the same time. The system can be transported and utilized wherever an electric power outlet is available. The system is shaped so that a person may place the system against the back of a chair, wherein the person leans back against the system to get a massage. The present invention may also be used to massage other parts of the body such as feet, arms and calves. In another embodiment of the invention, rather than comprising a portable massage system, the elements of the system can be permanently built into a lounge chair.

The present invention has vertically adjustable neck massage heads. This feature allows people to position the neck massage heads to best fit their size and desired comfort level. The invention also includes back massage heads. Both the neck and back massage heads may be selectively controlled to rotate at two different speeds, and can rotate in either a clockwise or counterclockwise direction. Both the neck and back massage heads may also be caused to vibrate at different levels and in different modes. The system includes padded removable covers for both the neck and back massage heads which absorb and soften the massage.

In accordance with a preferred embodiment of the invention, a multifunction massage system includes a body having a centerline. A pair of counter rotating neck massage heads are attached to the body, wherein one of the pair of neck massage heads is disposed on one side of the centerline and the other of the pair of neck massage heads is disposed on the opposite side of the centerline. At least one pair of counter rotating back massage heads are also attached to the body, wherein for each pair one back massage head is disposed on one side of the centerline and the other back massage head is disposed on the opposite side of the centerline. A user may lean against the multifunctional massage system and receive at least one of a neck massage and a back massage.

In accordance with an aspect of the invention, the pair of neck massage heads are selectively positionable along the centerline.

In accordance with another aspect of the invention, each neck massage head includes a rotating unit which rotates about a rotational axis, wherein the connection of the neck massage head is offset from said rotational axis.

In accordance with another aspect of the invention, the neck massage head has a central axis which is angled toward the rotational axis.

In accordance with another aspect of the invention, each back massage head includes first and second protruding knobs wherein the first knob is taller than the second knob.

In accordance with another aspect of the invention, the neck massage heads and the back massage heads are selectively vibrateable, in one of a plurality of selectable vibrational modes and frequencies.

In accordance with another aspect of the invention, a neck pad is selectively positionable over the neck massage heads to lessen the intensity of massage.

In accordance with another aspect of the invention, a back pad is selectively positionable over the back massage heads to lessen the intensity of massage.

In accordance with another aspect of the invention, the system includes an auto mode wherein a pre-programmed massage is delivered.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 9 is a side elevation view of the system with the outside cover removed;

FIG. 10 is a view in direction 10 of FIG. 9;

FIG. 11 is a view in direction 11 of FIG. 9;

FIG. 21 is and enlarged top plan view of a control unit; and,

FIG. 22 is a graph showing various vibration modes.

DETAILED DESCRIPTION OF THE INVENTION

Figure 1:
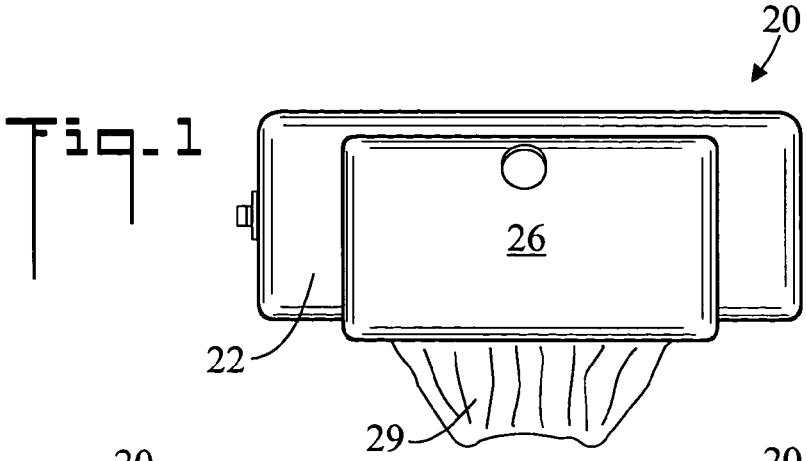
FIG. 1 is a top plan view of a multifunction massage system in accordance with the present invention.

Referring initially to FIGS. 1-4, there are illustrated top plan, front elevation, side elevation, and bottom plan views respectively of a multifunction massage system in accordance with the present invention, generally designated 20. System 20 includes a body 22 having a vertical centerline 24. In an embodiment of the invention, body 22 includes a metal frame 21 (refer to FIG. 9) which supports the various elements of the system. Frame 21 is surrounded by a polymer foam (such as Styrofoam) which gives the system the general shape of a chair back. A removable outside cover 26 such as of fabric, leather, simulated leather, or the like is placed over body 22, and covers the entire body 22 except for a window at the neck massage heads 28 (see below). Massage system 20 has the general appearance of an upper part of a car seat.

System 20 includes a pair of counter rotating neck massage heads 28 attached to frame 21 of body 22 (refer to FIG. 9). One of the pair of neck massage heads 28 is disposed on one side of centerline 24, and the other of the pair of neck massage heads 28 is disposed on the opposite side of centerline 24. Neck massage heads 28 are covered by a flexible covering 29 which allows the neck of a user to come into close contact with neck massage heads 28. System 20 also includes at least one pair of counter rotating back massage heads 30 attached to frame 21 of body 22, wherein for each pair one of the back massage heads 30 is disposed on one side of centerline 24 and the other back massage head 30 is disposed on the opposite side of centerline 24. In use, a user leans against multifunction massage system 20 and receives at least one of a neck massage and a back massage (refer to FIG. 20). A user can feel the back massage heads 30 through outside cover 26. System 20 also includes a control unit 32 which is utilized by a user to control the various massage functions of system 20. In the shown embodiment control unit 32 is hard wired to body 22, however remote control technology similar to that of a TV set could also be employed. Massage system 20 also includes a power switch 35 for turning the system ON or OFF.

Figure 3:
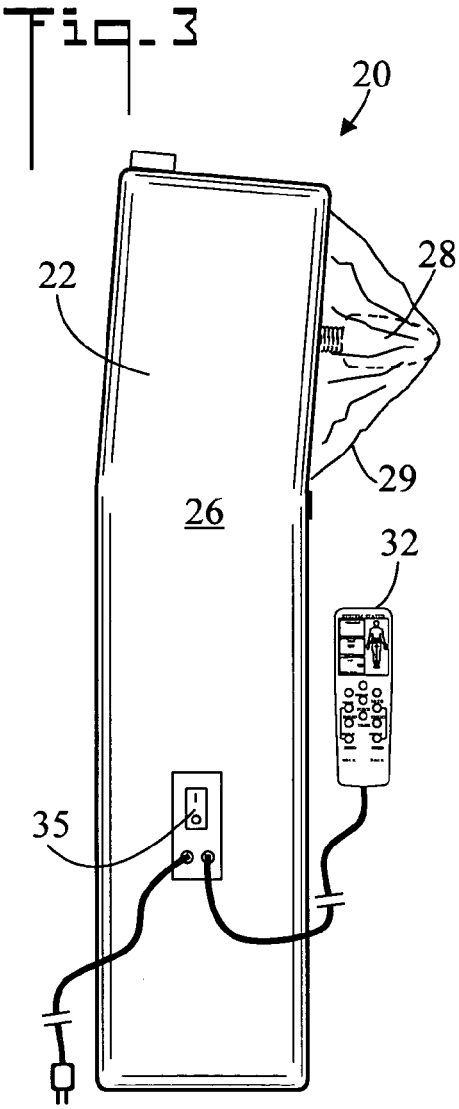
FIG. 3 is a side elevation view of the system.
Figure 2:
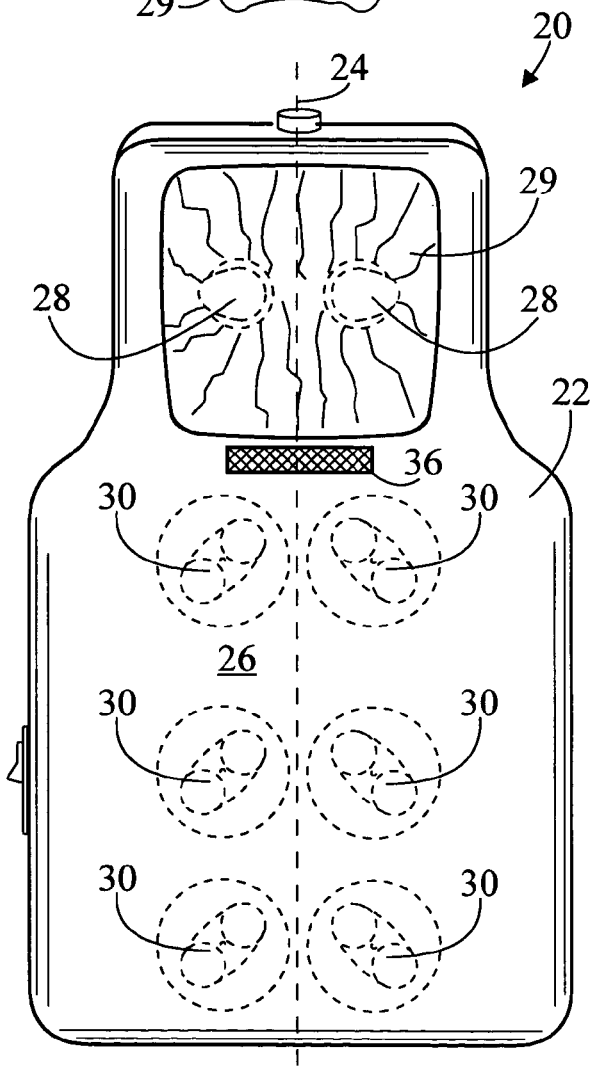
FIG. 2 is a front elevation view of the system.
Figure 4:
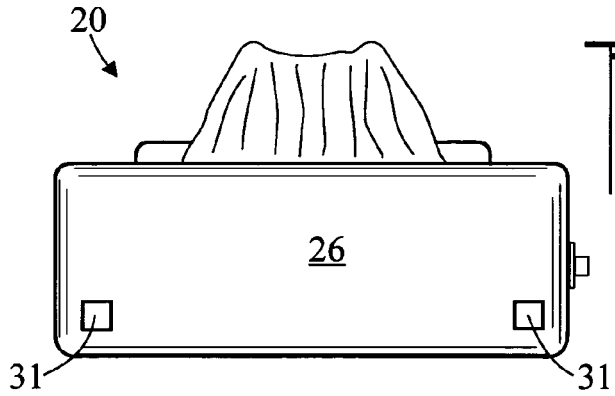
FIG. 4 is a bottom plan view of the system.

Referring now to FIG. 4, the bottom of system 20 includes two mounting holes 31 wherein system 20 can be mounted upon a special chair platform having two upstanding poles which are received by holes 31 to retain system 20 in a substantially vertical position as is depicted in FIGS. 2 and 3.

Figure 5:
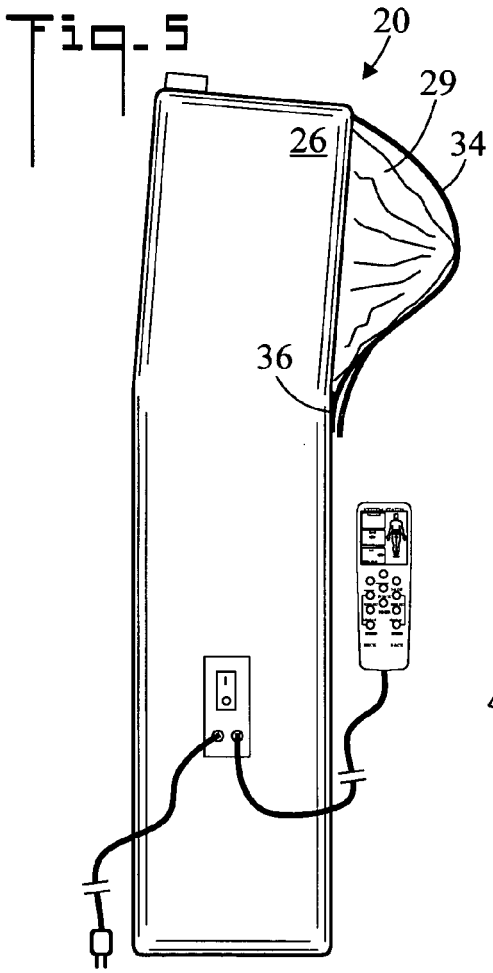
FIG. 5 is a side elevation view of the system with a neck pad in place.
Figure 6:
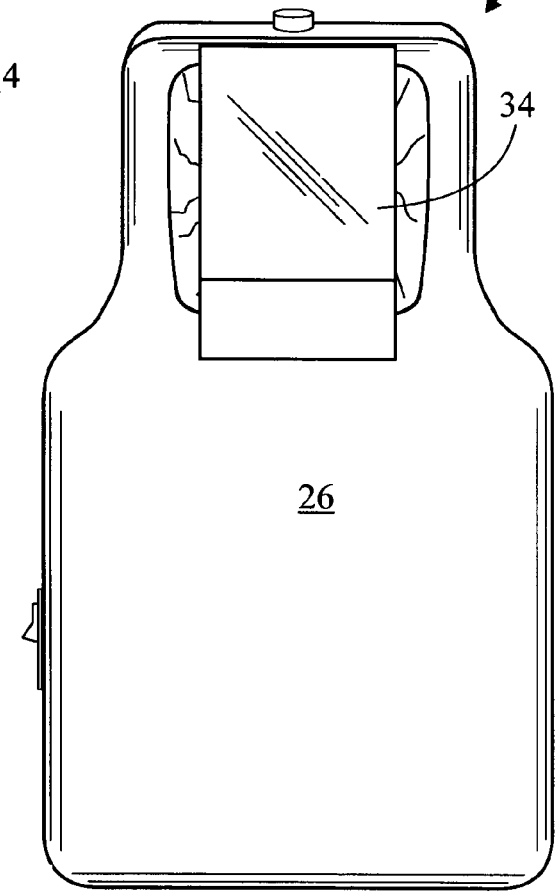
FIG. 6 is a front elevation view of the system with the neck pad in place.

FIGS. 5 and 6 are side elevation and front elevation views respectively of system 20 with a neck pad 34. Neck pad 34 is selectively positionable over neck massage heads 28 to lessen the intensity of the neck massage. That is, to absorb some of the energy of the massage heads. The upper portion of neck pad 34 if permanently attached to outside cover 26, and the lower portion of neck pad 34 is selectively connected to outside cover 26 by hoop and loop fasteners at 36.

Figure 7:
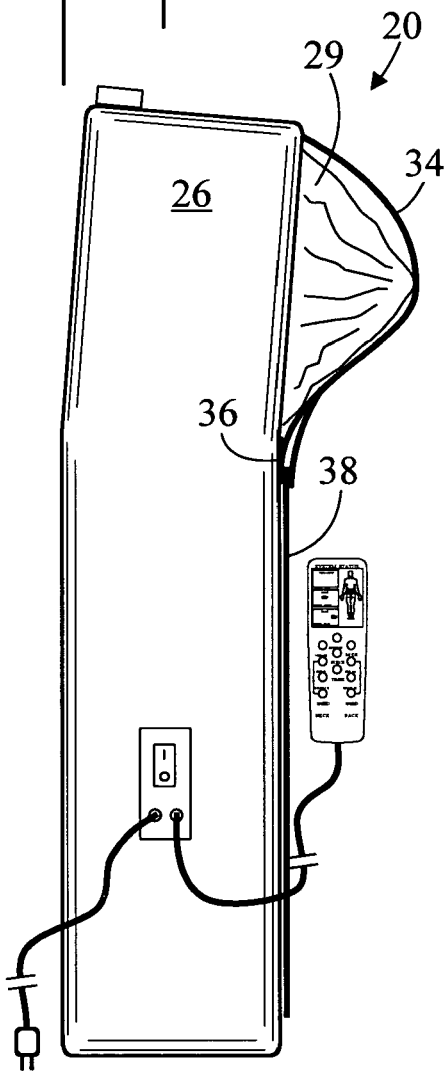
FIG. 7 is a side elevation view of the system with both the neck pad and a back pad in place.
Figure 8:
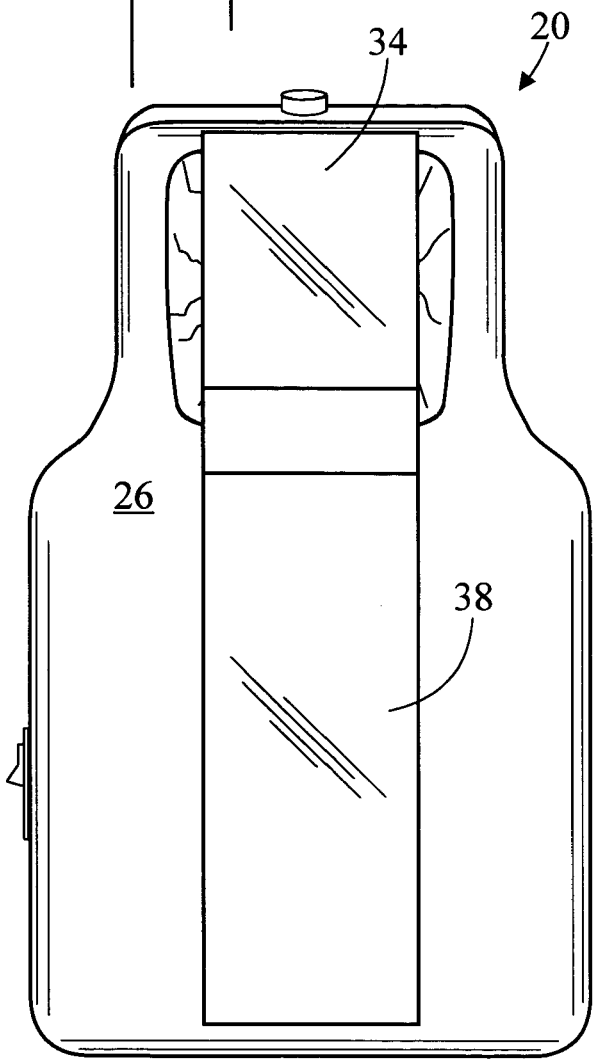
FIG. 8 is a front elevation view of the system with both the neck pad and the back pad in place.

FIGS. 7 and 8 are side elevation and front elevation views of system 20 with both the neck pad 34 and a back pad 38 in place. Back pad 38 is selectively positionable over back massage heads 30 to lessen the intensity of the back massage. In the shown embodiment, back pad 38 is used concurrently with neck pad 34, and is connected by hook and loop fasteners to neck pad 34. Back pad 38 may also be used without neck pad 34 wherein back pad 38 is connected to hook and loop fastener at 36.

FIG. 9 is a side elevation view of system 20 with outside cover 26 removed, and FIGS. 10 and 11 are views in directions 10 and 11 respectively of FIG. 9. The various components of system 20 such as the neck massage heads 28 and back massage heads 30 are connected to an underlying frame 21 which is surrounded by foam. In the shown preferred embodiment, system 20 includes three pairs of back massage heads 30. Also in a preferred embodiment of the invention, the pair of neck massage heads 28 are selectively positionable along centerline 24 (refer to dual arrows). This feature allows a person to adjust the position of neck massage heads 28 so as to align with their neck. In an embodiment of the invention, a drive screw 40 activated by vertical adjustment knob 42 is used to adjust the vertical position of a carriage upon which neck massage heads 28 are mounted. It may also be appreciated that the vertical position of neck massage heads 28 could be adjusted using a motorized system.

It is noted that back massage heads 30 are set back within body 22. Back massage heads 30 are also contoured to the back of a user. For example, the lowest back massage head 30 is raised a distance $\Delta H$ from the other back massage heads 30 to better conform to the lower back of a user.

Figure 18:
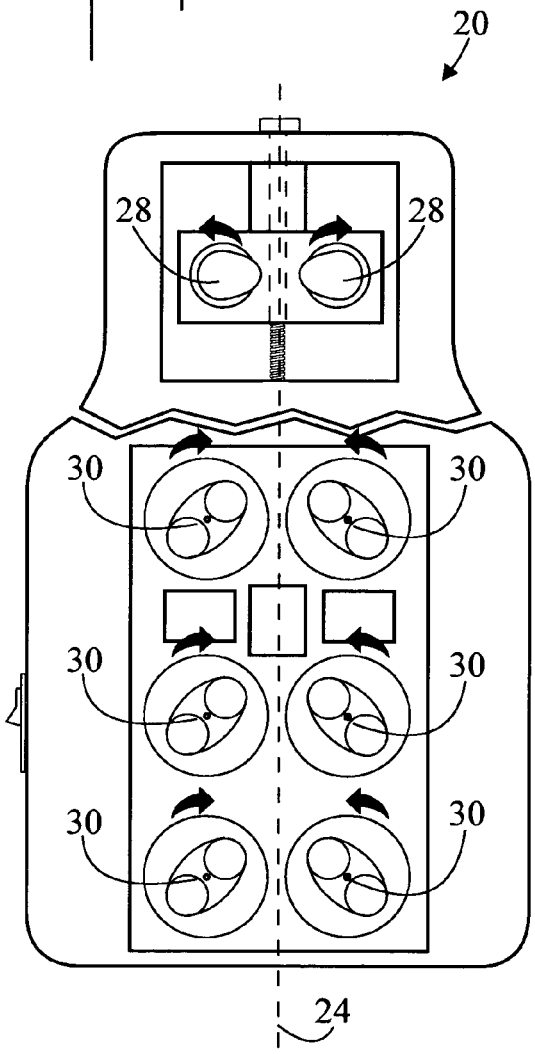
FIG. 18 is a front elevation view of the system showing the neck and back massage heads rotated to a different position.
Figure 19:
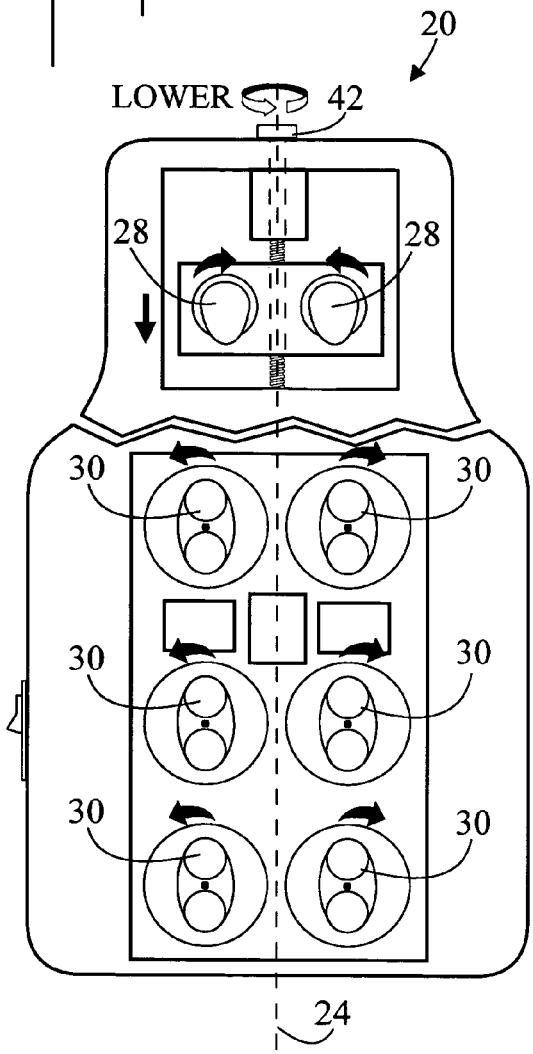
FIG. 19 is a front elevation view of the system showing the neck and back massage heads rotated to different position.

In another aspect of the invention, the direction of rotation of the neck massage heads 28 and of the back massage heads 30 is selectable (refer to FIGS. 18 and 19). In FIG. 18 the left neck massage head 28 is rotating counterclockwise and the right neck massage head 28 is rotating clockwise. This rotational configuration is defined as a first rotational direction. On the other hand, the left back massage heads 30 are rotating clockwise and the right back massage heads 30 are rotating counterclockwise. This rotational configuration is defined as a second rotational direction. It is also noted that the direction of rotation of the neck massage heads 28 and the direction of the back massage heads 30 may be changed independently.

Additionally, the speed of rotation of the neck massage heads 28 and of the back massage heads 30 are selectively and independently adjustable. In an embodiment of the invention two rotational speeds 40 rpm (FAST) and 25 rpm (SLOW) are provided for neck massage heads 28, and speeds of 30 rpm (FAST) and 20 rpm (SLOW) are provided for back massage heads 30. The rotation of the heads is effected by motors 44 (for back massage heads 30) and gearing (not shown) which are well known in the massage system art.

In another aspect of the invention, neck massage heads 28 and back massage heads 30 are selectively and independently vibrateable. The vibration is effected by vibration units 46 (for back massage heads 30) which are well know in the massage art. The vibration can be in one of a plurality of vibrational modes (refer to FIG. 22 and the discussion pertaining thereto). And also, the frequency of vibration may be selected. For neck massage heads 28, vibration frequencies between 3,300 vibrations per minute (HIGH) and 3,500 vibrations per minute (LOW) have been found useful. And for back massage heads 30, vibration frequencies between 3,600 vibrations per minute (LOW) and 4,000 (HIGH) have been found useful. Generally speaking, as the frequency is increased, the intensity (force) of the vibration increases.

Figure 12:
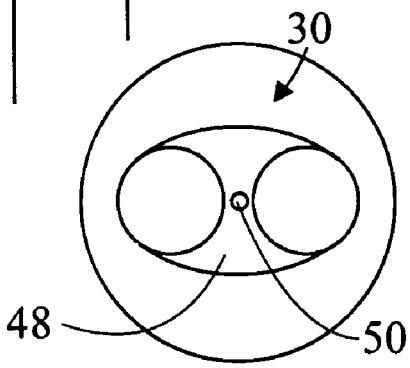
FIG. 12 is an enlarged top plan view of a back massage head.
Figure 13:
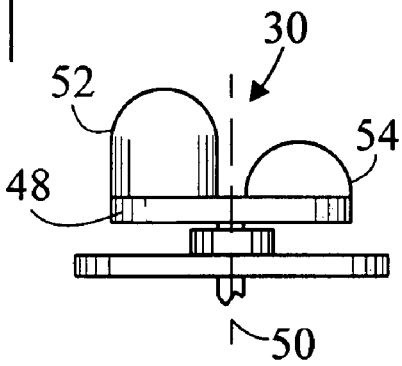
FIG. 13 is an enlarged side elevation view of the back massage head.
Figure 14:
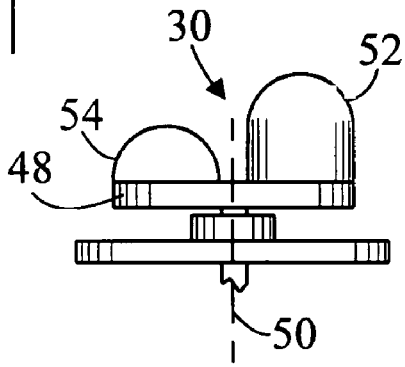
FIG. 14 is an enlarged side elevation view of the back massage head rotated 180°.

FIGS. 12 and 13 are enlarged top plan and side elevation views respectively of back massage head 30. Each back massage head 30 is attached to frame 21 (refer to FIG. 9) and includes a rotating member 48 which rotates about rotational axis 50. Back massage head 30 includes first 52 and second 54 protruding knobs wherein first knob 52 is taller than second knob 54. This uneven structure provides a user with a pulsating effect as the head rotates. FIG. 14 is an enlarged side elevation view of back massage head 30 rotated 180°.

Figure 15:
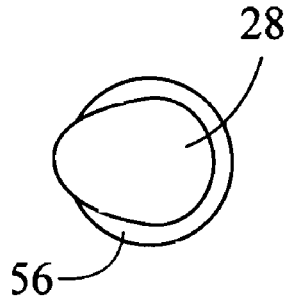
FIG. 15 is an enlarged top plan view of a neck massage head.
Figure 16:
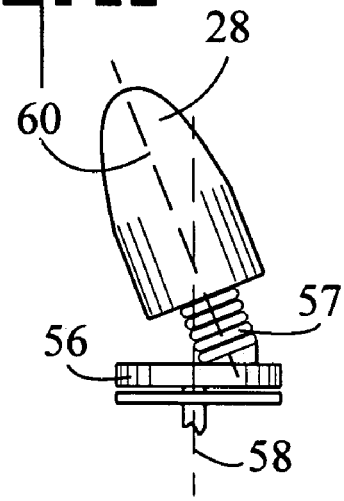
FIG. 16 is an enlarged side elevation view of the neck massage head.
Figure 17:
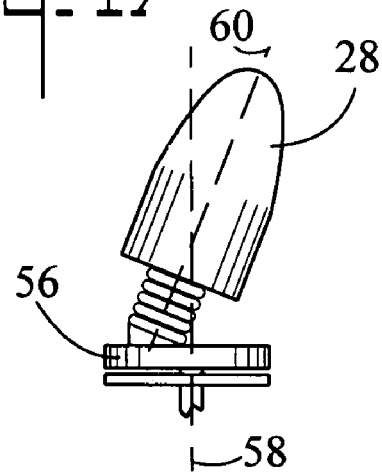
FIG. 17 is an enlarged side elevation view of the neck massage head rotated 180°.

FIGS. 15 and 16 are enlarged top plan and enlarged side elevation views respectively of neck massage head 28. Neck massage head 28 is connected to a rotating unit 56 which rotates about a rotational axis 58. In the shown embodiment, neck massage head 28 is connected to rotating unit 56 by a spring 57. The connection of neck massage head 28 to rotating unit 56 is offset from said rotational axis 58. In this manner as rotating unit 56 rotates, neck massage head 28 travels a circular path about rotational axis 58. Also, neck massage head 28 has a central axis 60 which is angled toward rotational axis 58. This feature accentuates the relative lateral motion of neck massage heads 28 so that the heads range from close together (refer to FIG. 18) to far apart (refer to FIG. 10). This feature provides the user with a "hands on" and "hands off" massage effect. FIG. 17 is an enlarged side elevation view of neck massage head rotated 180°.

FIG. 18 is a front elevation view of system 20 showing neck 28 and back massage heads 30 rotated to a different position from FIG. 10. Neck massage heads 28 have rotated from their outwardly pointing position in FIG. 10 to the inwardly pointing position of FIG. 18. The left neck massage head 28 has rotated in a counterclockwise direction, and the right neck massage head 28 has rotated in a clockwise direction (first rotational direction). It may be appreciated that FIGS. 10 and 18 show only two positions of neck heads 28 which are continuously rotating in opposite directions. This alternating outward and inward orientation of neck massage heads 28 provides the "hands on" (FIG. 18) and "hands off" (FIG. 10) effect. Similarly, the left side back massage heads 30 have rotated clockwise to the shown position, and the right side back massage heads 30 have rotated counterclockwise to the shown position (second rotational direction).

FIG. 19 is a front elevation view of system 20 showing neck 28 and back 30 massage heads rotated to another position. Neck massage heads 28 have rotated to a downward orientation with the left neck massage head 28 rotating clockwise and the right neck massage head 28 rotating counterclockwise. Additionally adjustment knob 42 has been used to lower the carriage containing neck massage heads 28, so as to conform to the body of a user. Also, the back massage heads have rotated to the shown vertical orientation, with the left side back massage heads 30 rotating counterclockwise and the right side back massage heads rotating clockwise.

Figure 20:
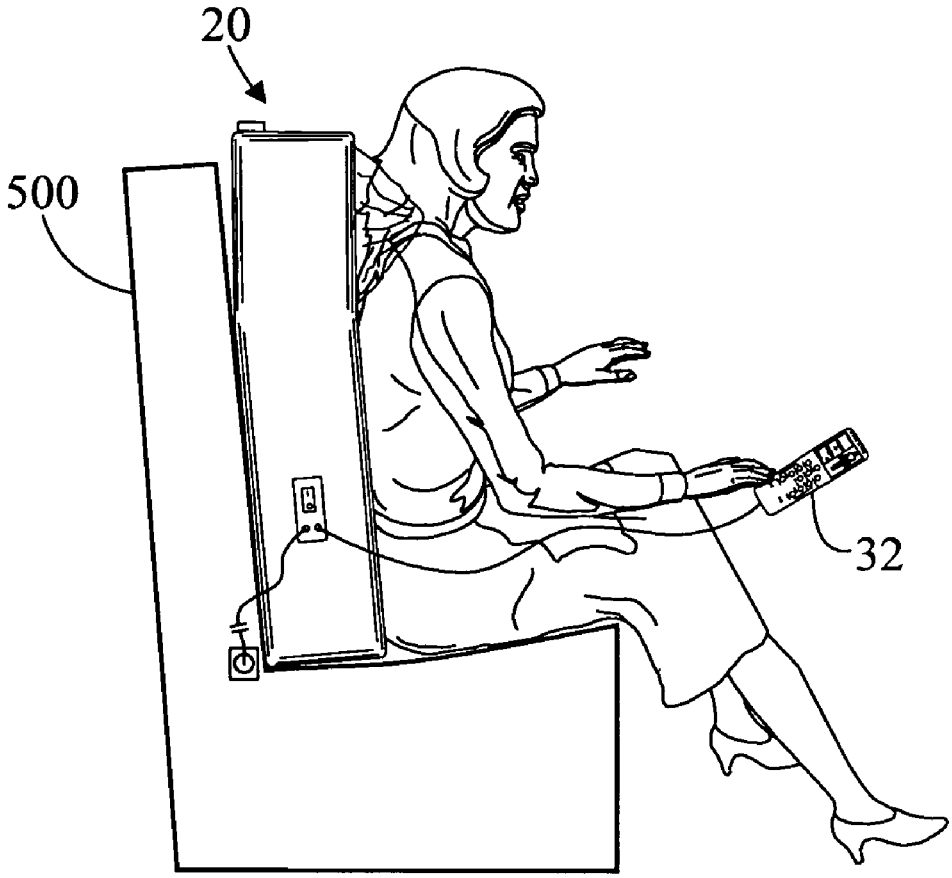
FIG. 20 is a reduced side elevation view of a person using the multifunction massage system.

FIG. 20 is a reduced side elevation view of a person using the multifunction massage system. Massage system 20 is placed between a user and the back of a chair 500. The user then leans back against massage system 20 and using control unit 32 selects the desired type of massage.

FIG. 21 is and enlarged top plan view of control unit 32. With power switch 35 turned ON (refer to FIG. 3), the AUTO/OFF button turns ON massage system 20. When the AUTO/OFF is initially pressed, massage system 20 enters an AUTO mode wherein a pre-programmed massage is delivered to the user. In an embodiment of the invention, the pre-programmed massage is set at the factory, and can include any sequence of the massage variations which are discussed below. It is noted however, that in another possible embodiment of the invention, a user could use control unit 32 to program his or her desired massage. The AUTO mode massage will continue for a predetermined period (for example 10 minutes) at which time massage system 20 will automatically shut OFF. The predetermined period may be changed using the TIMER button.

When the AUTO/OFF button is pressed a second time, massage system 20 enters a MANUEL mode. In the MANUEL mode a user can select one or more of the various massage options discussed below. When AUTO/OFF button is pressed again, all massage functions are turned OFF.

Massage Options:

The alternate action KNEAD, REVERSE, and SPEED buttons on the left side of control unit 32 control neck massage heads 28. Pressing the KNEAD button a first time causes neck massage heads 28 to rotate. Pressing the KNEAD button a second time causes neck massage heads 28 to stop rotating (etc.). Alternately pressing the REVERSE button causes the direction of rotation of the counter rotating neck massage heads 28 to change between a first rotational direction and a second rotational direction. Alternately pressing the SPEED button causes the speed of rotation of neck massage heads 28 to change between FAST and SLOW.

The alternate action KNEAD, REVERSE, and SPEED buttons on the right side of control unit 32 control back massage heads 30. Pressing the KNEAD button a first time causes back massage heads 30 to rotate. Pressing the KNEAD button a second time causes back massage heads 30 to stop rotating (etc.). Alternately pressing the REVERSE button causes the direction of rotation of the counter rotating back massage heads 30 to change. Alternately pressing the SPEED button causes the speed of rotation of back massage heads 30 to change between FAST and SLOW.

The alternate action TIMER button causes the time of the massage to change. Times of 10 minutes, 20 minutes, and 30 minutes are provided. After the selected time runs out, massage system 20 automatically shuts down.

The alternate action VIBRATE button causes both the neck massage heads 28 and back massage heads 30 to vibrate or not vibrate.

The alternate action FORCE button causes the intensity of vibration to change between HIGH and LOW.

The alternate action MODE button causes the mode of vibration to change between PULSED, TAPPED, and WAVE (refer to FIG. 22).

Control unit 32 also includes a system status panel 60 which shows the selected massage modes. In the shown example, VIBRATE is OFF. The neck massage heads 28 are rotating at a SLOW speed, with the right head rotating counterclockwise and the left head rotating clockwise. And, the back massage heads 30 are rotating at a FAST speed, with the right heads rotating clockwise and the left heads rotating counterclockwise.

FIG. 22 is a graph showing the various vibrational modes of massage system 20. In the PULSED mode the vibration is quickly turned ON and then OFF. In the TAPPED mode the vibration is turned ON for a long period and then turned OFF briefly. In the WAVE mode the vibration follows a sine curve. These modes are programmed into a memory in control unit 32.

In terms of use, a method of providing a massage includes:

(a) providing a multifunction massage system 20 including:

a body 22 having a centerline 24;

a pair of counter rotating neck massage heads 28 attached to body 22, wherein one of the pair of neck massage heads 28 is disposed on one side of centerline 24 and the other of the pair of neck massage heads 28 is disposed on the opposite side of centerline 24;

at least one pair of counter rotating back massage heads 30 attached to body 22, wherein for each pair one back massage head 30 is disposed on one side of centerline 24 and the other back massage head 30 is disposed on the opposite side of centerline 24; and, (b) a user leaning against massage system 20 and receiving at least one of a neck massage and a back massage.

The method further including:

in step (a), the pair of neck massage heads 28 being selectively positionable along centerline 24; and, (c) a user positioning neck massage heads 28 to a desired position along centerline 24. The method further including:

in step (a), a direction of rotation of the neck massage heads 28 and of back massage heads 30 being selectable between a first rotational direction and a second rotational direction;

in step (a), a speed of rotation of the neck massage heads 28 and of the back massage heads 30 being selectively adjustable;

in step (a), the neck massage heads 28 and the back massage heads 30 selectively vibrateable, wherein the frequency of vibration is selectable;

in step (a) the vibration being in one of a plurality of selectable vibrational modes;

in step (a) providing a selectable time of massage; and, (c) a user selectively performing at least one of the following:

changing said direction of rotation of the neck massage heads 28;

changing said direction of rotation of said back massage heads 30;

changing said speed of rotation of said neck massage heads 28;

changing said sped of rotation of said back massage heads 30;

causing said neck 28 and back 30 massage heads to vibrate;

changing the frequency of vibration of the neck 28 and back 30 massage heads;

changing the vibrational mode of the neck 28 and back 30 massage heads; and, changing the time of massage.

The preferred embodiments of the invention described herein are exemplary and numerous modifications, variations, and rearrangements can be readily envisioned to achieve an equivalent result, all of which are intended to be embraced within the scope of the appended claims.

I claim:

1. A multifunction massage system, comprising:

a body having a centerline;

a pair of counter rotating neck massage heads attached to said body, wherein one of said pair of neck massage heads is disposed on one side of said centerline and the other of said pair of neck massage heads is disposed on the opposite side of said centerline;

at least one pair of counter rotating back massage heads attached to said body, wherein for each said pair one said back massage head is disposed on one side of said centerline and the other said back massage head is disposed on the opposite side of said centerline, so that a user may lean against said multifunctional massage system and receive at least one of a neck massage and a back massage;

each said neck massage head disposed on a rotating unit which rotates about a rotational axis;

each said massage head having a proximal end connected to said rotating unit, and an opposite distal end;

each said neck massage head disposed on said rotating unit so that said proximal end of said neck massage head is offset from said rotational axis; and, each said neck massage head having a central axis which passes through said proximal end and said distal end and which outwardly projects from said rotating unit toward said rotational axis, wherein said distal end of said neck massage head resides on one side of said rotational axis and said proximal end of said neck massage head resides on the opposite side of said rotational axis.

* * * * *